United States Patent [19]

Lacey

[11] 3,999,543

[45] Dec. 28, 1976

[54] MEDICAMENT ADDITIVE SYSTEM

[75] Inventor: Robert Louis Lacey, Palatine, Ill.

[73] Assignee: Illinois Tool Works Inc., Chicago, Ill.

[22] Filed: Feb. 6, 1976

[21] Appl. No.: 656,049

[52] U.S. Cl. ..... 128/272; 141/329

[51] Int. Cl.[2] ..... A61J 1/00

[58] Field of Search ..... 128/272, 272.1, 272.3, 128/220, 221, 218 M, 218 R, 215, 216, DIG. 26, DIG. 28, 214 R; 141/329, 330

[56] References Cited

UNITED STATES PATENTS

| | | | |
|---|---|---|---|
| 3,484,849 | 12/1969 | Huebner et al. | 128/272.3 X |
| 3,796,218 | 3/1974 | Burke et al. | 128/221 X |
| 3,872,867 | 3/1975 | Killinger | 128/272 |
| 3,885,607 | 5/1975 | Peltier | 128/272 X |
| 3,938,518 | 2/1976 | Tischlinger | 128/272 |

*Primary Examiner*—John D. Yasko
*Attorney, Agent, or Firm*—J. R. Halvorsen; R. W. Beart

[57] ABSTRACT

A system for the introduction of a medicament from a sealed vial into a sealed secondary solution container through the use of an infusor having sharpened tubular members extending outwardly from opposite ends of a body with a single lumen interconnecting said tubular members. The members at opposite ends piercing the sealed elements of the vial and secondary container to provide a sterile transfer of the medicament from the vial to the secondary solution container.

19 Claims, 7 Drawing Figures

MEDICAMENT ADDITIVE SYSTEM

BACKGROUND OF THE INVENTION

In the medical arts field of endeavor there is often a need of introducing a medicine into an intravenous (IV) solution container which is used to feed or control the vital signs of a patient by introducing the solution into the vein of a patient through a catheter and cannula combination. In the past it has been necessary for the technician or doctor to use a syringe to withdraw a medicament from a sealed vial and to then insert the syringe cannula through the stopper of the IV solution container to permit mixing of the medicament with the solution stored in said container. A primary deficiency of this prior art approach is the problem of maintaining sterility in such additive transfer process. The closure for the vial must be maintained sterile, the closure for the IV solution bottle must be maintained sterile and the problem of maintaining sterility in the syringe and its attached cannula will be apparent to those skilled in the art.

SUMMARY OF THE INVENTION

The present invention relates to a system for the introduction of a medicament from a sealed vial into a sealed secondary solution container through the use of an infusor capable of penetrating the sealing means in the vial at one end of the infusor, penetrating the sealing means of the secondary container at its opposite end and means for controlling the evacuation of medicament from the vial in a predetermined pattern into the solution container.

It is a primary object of the present invention to provide a system of the type described hereinabove wherein the infusor and medicament vial can be prepackaged in a sterile condition either as separate items or as a preassembled unit for immediate use by hospital personnel.

A further object of the present invention is to provide an infusor capable of penetrating the sealed plunger in the medicament vial by axial movement of the infusor within the vial, with the infusor having secondary means for restraining unintentional further axial movement but permitting such axial movement when intentionally desired to evacuate the contents of the vial through the infusor.

Still another object of the present invention is to provide an economical single use prepackaged sterile medicament container and infusor for introducing the medicament into an IV solution container for administration to the patient by an IV catheter set.

Other objects of the present invention will be apparent to those skilled in the art when the following specification is read in conjunction with the attached drawing.

DETAILED SPECIFICATION

Figure 1:
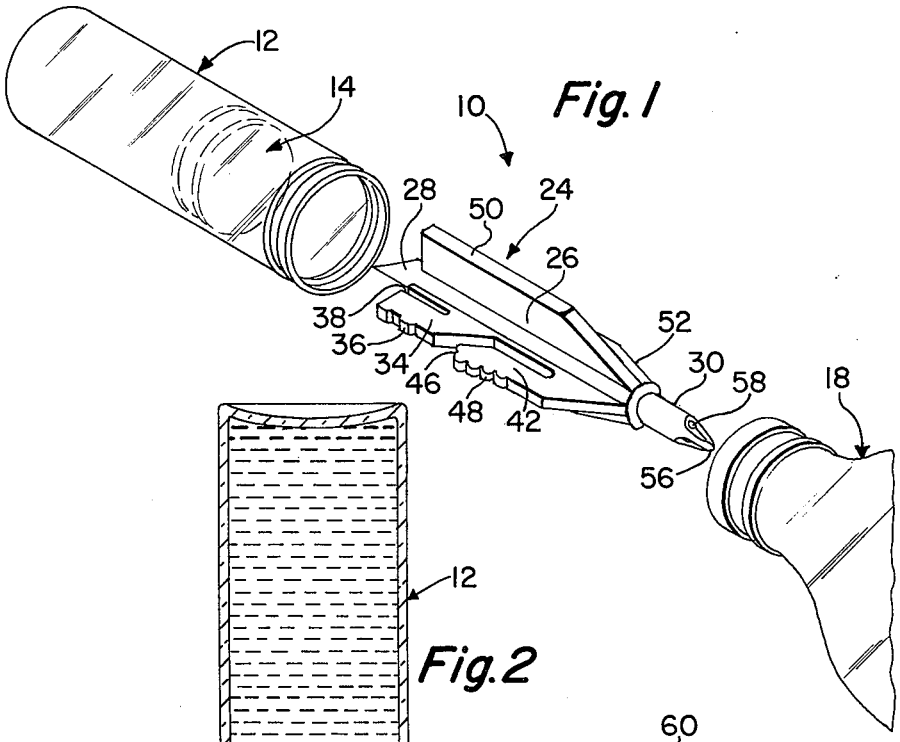
FIG. 1 is an exploded view in perspective of the various elements making up the system of the present invention.
Figure 3:
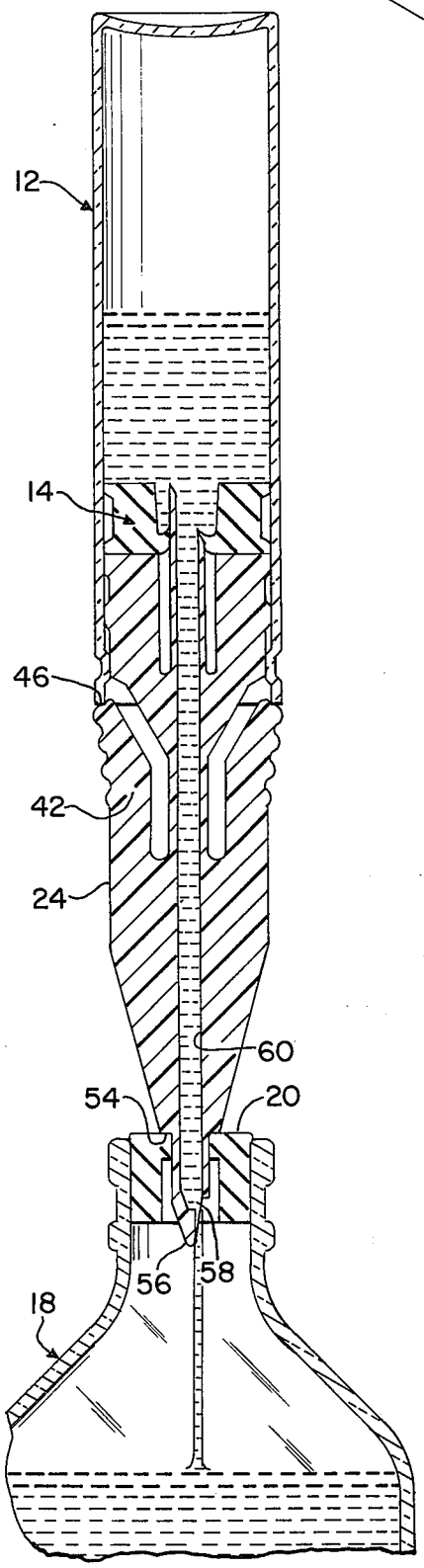
FIG. 3 is an elevational view and partial section of the infusor and vial of FIG. 2 showing the infusor in axially moved position to the point of penetration of the sealed plunger and also illustrating the introduction of the infusor into the sealed stopper of the IV solution container.

Referring now to the drawing wherein similar parts are designated by similar numerals, a medicament additive system 10 of the type contemplated by the present invention would include a vial 12 open at one end which is sealingly closed by a plunger 14 having annular sealing ribs or rings for engaging the interior wall of the vial 12 and a centrally disposed diaphram 16 which is capable of being pierced. The medicament carried by vial 12 is to be transferred to a secondary solution container 18 such as a typical IV solution bottle, either glass or plastic as is well known in the art, this container having a pierceable stopper 20 closing its open mouth and can, if desired, have a metal or plastic overlay keeping the exposed end of the stopper in an aseptic condition, not shown, as it common in the art.

To interconnect the vial with the solution container this invention provides an infusor 24 having a body 26, which in the present invention is generally cruciform in cross-section for purposes of saving material for economies in manufacture. It should be recognized that other configurations of the body such as a plurality of annular rings interconnected by webs or a cylindrical body form internally supported could be utilized. Extending outwardly from opposite ends of the body 26 are sharpened tubular members 28 and 30 with said tubular members extending a predetermined distance from the ends of said body.

One end of the infusor includes a transversly extending surface 32, this is the top end as viewed in the drawing. Adjacent this top end is located resilient means in the form of one or more arms 34 having a plurality of transverse ribs 36 along its outer surface or edge and an axially extending slot 38 which spaces the arm 34 from the adjacent portion and thereby permits it to be resiliently movable in a radial direction in a hinge-like fashion about its end connection designated by the numeral 40. Axially spaced along the body and intermediate its extremities is a second resilient means which in the present embodiment takes the form of a second pair of arms 42 spaced from the main body by slots 44 to thereby permit the arms 42 to be radially resiliently movable. The ends of the arms 42 have abutment means 46 in the form of a shoulder and groove generally complementary to the end of the vial 12. The outer edge surface of arms 42 are also provided with transverse abutments or ribs 48. It should be noted that the normal diametral extent of the ribs 36 on arms 34 and the abutments 46 on arms 42 fall laterally outwardly of an imaginary cylinder equal to the internal diameter of vial 12, for purposes best set forth hereinafter.

In quadrature to the portions of the cruciform body carrying arms 34 and 42 are a pair of rib members 50 having their major diametral extent falling on the imaginary cylinder equal to or slightly less than the internal diameter of vial 12 to locate the infusor centrally within said vial when telescopically introduced therein.

The opposite end of the infusor is tapered as at 52 and terminates in a shoulder 54 spaced from the end of the sharpened tubular member 30. Each of the legs of the cruciform body fall on this imaginary frustoconcial surface. It should be noted that in the illustrated embodiment the tubular member 30 is provided with a conical solid end 56 and one or more side ports 58 communicating with the lumen 60 that passes continuously and completely through the tubular members 28 and 30 and the central body portion of the infusor. For various applications it should be recognized that other developed tips 56 could be utilized on the tubular extension 30.

Figure 2:
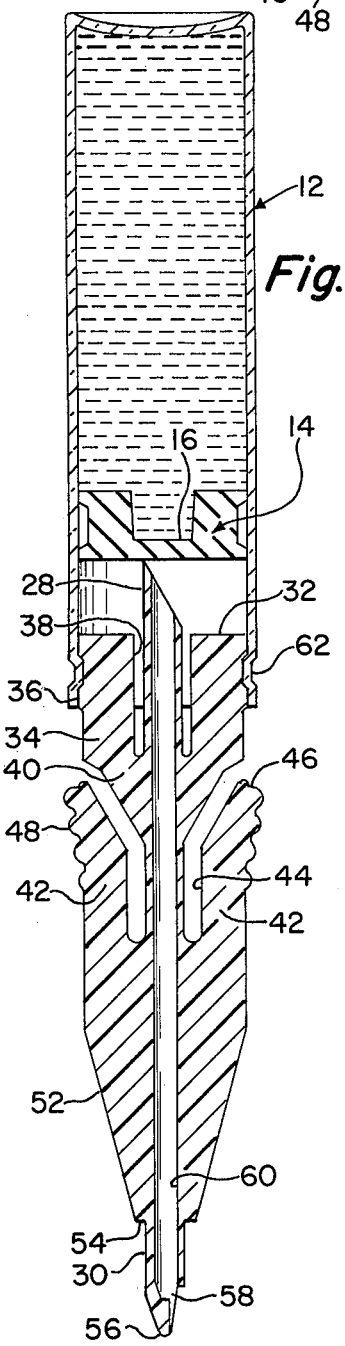
FIG. 2 is an elevational view in section showing the infusor and sealed vial in preassembled relation.
Figure 4:
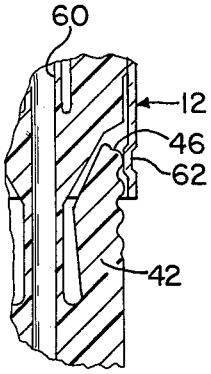
FIG. 4 is a partial sectional view showing the release of the restraining means to permit further axial movement of the infusor relative to the vial.
Figure 5:
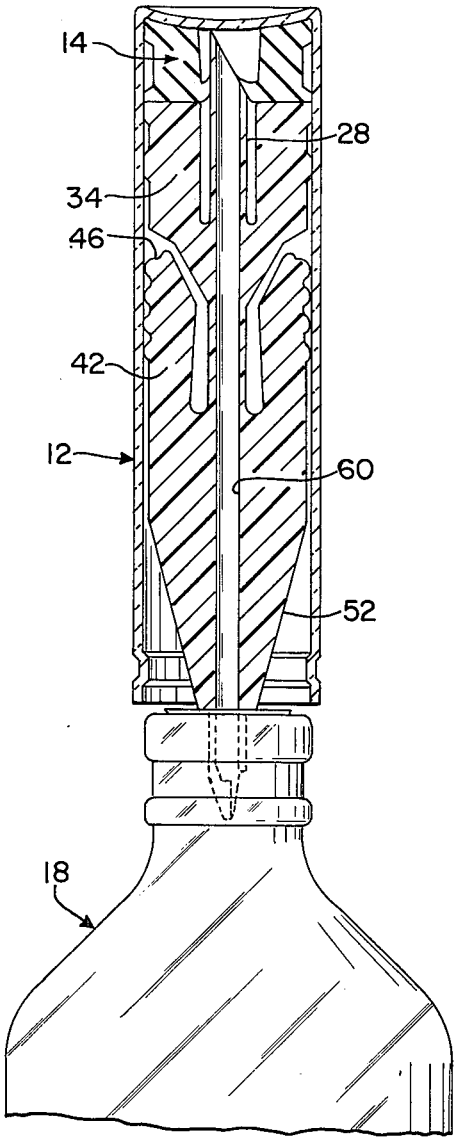
FIG. 5 is an elevational view and partial section showing the infusor and sealing plunger of the vial with the vial being axially moved relative to the infusor to its final position.

In the use of this system the total unit product of the vial and infusor would be contained in a sterile package ready for use. The two elements could be packaged side-by-side or could be preassembled in axial relationship, as generally shown in FIG. 2. It will be noted that the plunger or stopper 14 within the vial is initially positioned in spaced predetermined position relative to the open end of the vial 12. The primary purpose of this is to permit the preassembly of the infusor 24 with the vial 12. In the present embodiment the vial 12 is provided with an annular ring 62 forming a groove on the exterior surface of the vial and an inwardly directed rib on the interior. The ribs 36 on legs 34 are axially spaced and designed to cooperate with the ribs 62. Thus by radially compressing the arms 34 inwardly the infusor is snapped into the vial in cooperating relationship with the annular ring 62 whereby the sharpened tubular member 28 is positioned adjacent to the diaphram 16 of plunger 14. The diaphragm 16 of vial plunger 14 is pierced by forcing the infusor 24 into the vial until the abutment shoulder means 46 carried by spring arms 42 are brought into contact with the free end edges of the vial 12. At this point the diaphragm has been pierced, sufficient medicament has been ejected to clear air from the passageway of lumen 60 and the infusor is ready to be inserted into the solution bottle stopper 20. It should be noted at this point that, if desired, it is possible to provide a separate cover for the sharpened tubular member 30 which would be removed immediately prior to insertion and piercing of the exposed solution bottle stopper 20. If the stopper 20 has a secondary protective cover it too would be removed prior to the next step. The technician would then insert the tubular member 30, by forcing the conical tip 60 through the stopper 20, to provide egress by the port 50 into the interior of the bottle 18. When this has been accomplished the arm 42 is moved radially inwardly, as seen in FIG. 4, and the vial 12 is moved axially relative to the infusor 24. The end surfaces 32, being in engagement with the plunger 14, will force the plunger axially relative to the interior of the vial and cause an evacuation of the medicament from the interior of the vial until the plunger reaches the opposite end of the vial, as seen in FIG. 5. When all of the medicament has been injected into the IV solution bottle the entire unit of vial, plunger and infusor is then removed and discarded with the IV solution container 18 then being ready to be utilized for administration to the patient. It will be appreciated that when the preassembled unit of the medicament vial and infusor are sterilely packaged, in the position shown in FIG. 2, that the security of the device is insured since there is no ready way for the contents of the vial 12 to be tampered with without such tampering being apparent to the ultimate user.

The embodiment disclosed hereinabove and particularly the infusor ean be fabricated as a one-piece injection molded plastic device. Under certain circumstances it is desirable to provide alternates to that type of construction and such alternates will be discussed below.

Figure 6:
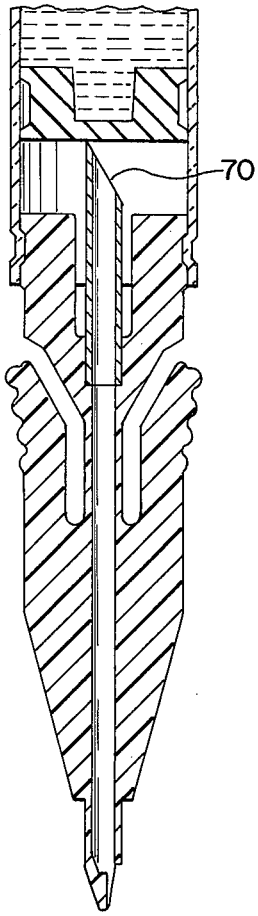
FIG. 6 is an elevational view and partial section of a modification to the present invention.

Referring now to FIG. 6, a modification to the present invention would be to substitute a metallic sharpened cannula 70 in place of the integral sharpened tubular member 28. One of the reasons for such a material substitution would be for increased strength to permit penetration of a diaphram which would be thicker or stronger than that shown in the previous embodiment.

Figure 7:
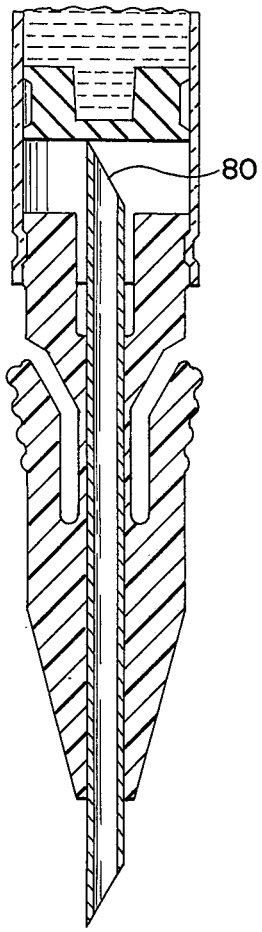
FIG. 7 is an elevational view and partial section of a second modification to the present invention.

A further embodiment of the present invention can be seen in FIG. 7 wherein the lumen is provided by a single cannula 80 sharpened at both ends. Such a cannula would be insert-molded within the body and preferably would be fabricated of stainless steel for sterility and sanitation purposes. It can be appreciated that the use of either a partial metallic cannula 70, as shown in FIG. 6, or a total metallic cannula 80, as shown in FIG. 7, would have the advantage of permitting the use of certain inexpensive materials for fabrication of the infusor or might be required where the particular medicament would be incompatible with the thermoplastic material used to form the infusor.

The presentment of the should 54 at the end of the tapered section 52 limits the penetration of the sharpened tubular member 3 into the stopper of the IV bottle. This, therefore, eliminates the possibility of aspirating fluids from the IV bottle into the vial. Also the straight tubular member 28 would be withdrawn from the diaphragm 16 if such aspiration were attempted and which normally would be undesirable. Other modifications to the body configuration will be apparent to those skilled in the art with the only requirement being the ability to pierce the plunger diaphragm 16 and the stopper 20 prior to the axial telescopic movement of the vial relative to the infusor for purposes of ejecting the medicament through the lumen 60 into the secondary container 18. This is of course accomplished by the flexible arm 42 which can be one or more in number, even through the illustrated embodiment shows two such arms one arm will suffice. This gives the operator the positive assurance that piercing of the two sealing elements is accomplished before the one or more arms are moved radially inwardly to permit the evacuation of the medicament by axial movement of the vial relative to the infusor.

I claim:

1. An additive system for the introduction of a medicament into a secondary solution container, including a medicament vial having a sealing plunger closing an open end of said vial, said plunger having a transversely disposed perforable portion, an infusor including an elongated body, sharp tubular elements extending axially from opposite ends of said body, an axially extending lumen communicating with opposite ends of said body and through said tubular elements, means disposed at one end of said body for locating said body within an open end of said vial, second resilient means disposed intermediate the ends of said body and providing abutment means capable of engaging said vial to limit the axial movement of said body relative to said vial when said one end is introduced into said vial, said second resilient means being movable radially inwardly to disengage said abutment means from the vial to permit telescoping of said body into said vial, the sharp tubular element extending from said one end adapted to pierce said diaphragm and provide communication for passage of said medicament in said vial into said lumen, the tubular element extending from said opposite end adapted to communicate with the interior of said secondary solution container for the purpose of delivering said medicament to said solution.

2. A system of the type claimed in Claim 1 wherein said plunger is initially positioned in spaced relation to the open end of said vial whereby said means disposed at one end of said body can be positioned within said vial to permit preassembly of said infusor and vial without piercing of said diaphragm.

3. A system of the type claimed in claim 2 wherein the spacing of said plunger from the end of the vial, the extent of projection of said tubular element from said one end of the body and the position of said second resilient means are controlled relative to each other so that said diaphragm is pierced and access of medicament to said lumen is provided when said shoulder means are brought into contact with said vial.

4. A system of the type claimed in claim 1 wherein the said one end of said body includes shoulder means for engaging said plunger to limit penetration of said tubular element through said diaphragm and additionally act as a means for moving the plunger relative to said vial to cause evacuation of the medicament through said lumen.

5. A system of the type claimed in claim 1 wherein said second resilient means includes at least one movable axially extending arm fixed at one end relative to said body and extending laterally therefrom to provide an abutment means facing said one end to engage said vial.

6. A system of the type claimed in claim 5 wherein at least one of said tubular elements and a portion of said lumen is formed from a dissimilar material from said body.

7. A system of the type claimed in claim 5 wherein said body is plastic material and said at least one tubular element and a portion of said lumen is metallic in nature.

8. A system of the type claimed in claim 5 wherein said infusor is a one piece injection molded thermoplastic member.

9. A system of the type claimed in claim 5 wherein said vial includes means adjacent its open free end for cooperating with the means disposed at said one end of said body to retain said infusor in preassembled relation.

10. A system of the type claimed in claim 9 wherein said vial and body means includes annular rib means and cooperating groove means on said vial and body.

11. A system of the type claimed in claim 5 wherein said opposite end of said body is tapered and terminates in an abrupt transverse shoulder spaced from the end of said sharp tubular member a predetermined amount, said secondary container having a pierceable stopper, said shoulder limiting the extent of penetration of said tubular member into said stopper.

12. A system of the type claimed in claim 5 wherein said lumen is defined by a metallic cannula sharpened at both ends and extending outwardly a predetermined distance beyond each opposite end of said body.

13. A system of the type claimed in claim 1 wherein said infusor body is cruciform in cross-sectional configuration.

14. A system of the type claimed in claim 13 wherein said means adjacent one end includes an axially disposed radially resilient portion of at least one of the axially disposed cruciform arms having means along its outer edge for engaging said vial.

15. A system of the type claimed in claim 14 wherein said means adjacent one end and said second means are each disposed along a common arm of said cruciform body.

16. A system of the type claimed in claim 15 wherein said means and said second means are each two in number and disposed on those arms of the cruciform body extending in opposite directions said falling in a common plane while those intermediate arms in quadrature being substantially smooth along their edges which fall on an imaginary cylinder equal to the internal diameter of said vial for guiding the body into said vial, said means and said second means both initially having a diametral extent greater than said imaginary cylinder but being capable of being radially collapsed toward one another to assume a diameter equal to or less than said cylinder.

17. A system of the type claimed in claim 1 wherein said sealed vial and said infusor are encased in a common sterile package.

18. A system of the type claimed in claim 17 wherein said vial and infusor are preassembled as a coaxially disposed common unit enclosed in a common sterile package.

19. A system of the type claimed in claim 11 wherein said tubular member adjacent said shoulder having a lateral port communicating with said lumen and a conical closed point.

* * * * *